United States Patent [19]

Sakamoto et al.

[11] Patent Number: 4,500,631

[45] Date of Patent: Feb. 19, 1985

[54] RADIOGRAPHIC IMAGE FORMING PROCESS

[75] Inventors: Eiichi Sakamoto; Mikio Kawasaki; Kouji Ono; Kakujulo Fukuoji; Noboru Fujimori, all of Hino, Japan

[73] Assignee: Konishiroku Photo Industry Co., Ltd., Tokyo, Japan

[21] Appl. No.: 520,829

[22] Filed: Aug. 5, 1983

[30] Foreign Application Priority Data

Aug. 12, 1982 [JP] Japan ..... 57-140743

[51] Int. Cl.[3] ..... G03C 5/24; G03C 5/16

[52] U.S. Cl. ..... 430/413; 430/517; 430/518; 430/519; 430/522; 430/966; 430/967; 430/416

[58] Field of Search ..... 430/966, 967, 522, 517, 430/518, 519, 413, 416

[56] References Cited

PUBLICATIONS

Chem. Absts., vol. 91, 1979, 115327h.

*Primary Examiner*—Mary F. Downey

*Attorney, Agent, or Firm*—Jordan B. Bierman

[57] ABSTRACT

A radiographic image forming process comprising imagewise exposing a negative type silver halide light-sensitive photographic material in combination with a fluorescent intensifying screen to radiation and then treating said material with a processing solution, said material comprising a support and constituent layers coated on both sides of said support, said layers containing (a) light sensitive silver halide particles, (b) metallic salt particles which are not light-sensitive and, when untreated, are more soluble in said processing solution than said silver halide particles, said metallic salt particles having been treated so that the surface thereof has been rendered less soluble than said silver halide by a dissolution retarder, (c) physical development nuclei, and (d) compounds selected from water soluble dyes having absorption maxima in an aqueous solution of from 400 to 600 nm or compounds selected from said water soluble dyes coupled to a non-diffusive mordant, and said processing solution containing at least one reducing agent and at least one substance which is capable of dissolving said metallic salt particles.

22 Claims, 1 Drawing Figure

RADIOGRAPHIC IMAGE FORMING PROCESS

BACKGROUND OF THE INVENTION

The invention relates to an image forming process of a novel silver halide light-sensitive photographic material for radiographic use. More particularly, a very sharp radiographic image forming process is described in which improvements are made in reducing deterioration of image sharpness which results from cross-over light on negative type silver halide light-sensitive photographic materials provided on both surfaces of a transparent support (hereinafter called the light-sensitive material).

Generally, most light-sensitive materials for forming radiographic images require satisfactory sensitivity and contrast. These requirements are satisfied by having light-sensitive silver halide emulsions coated on both surfaces of the support. However, image sharpness and contrast are found to deteriorate, primarily as a result of the "cross-over" phenomenon. This phenomenon results when radiographic light-sensitive materials coated both sides of the support are sandwiched between two fluorescent intensifying screens.

To be more concrete, light emitted from one of the fluorescent intensifying screens hits the silver halide emulsion layer directly contacting that screen. At the same time, the light is transmitted through the silver halide emulsion layer and the support thereof and hits the silver halide emulsion layer on the opposite side. The result is an image having poor sharpness.

The reason image sharpness deteriorates with cross-over light is that the image forming field is spread by optical refraction and by reflection diffusion in each of the fluorescent intensifying screens, silver halide emulsion layers, and supports.

Means for eliminating the above-mentioned cross-over light may be devised, such as that in which a support is colored or a reflective support is used. However, it has not been possible to eliminate or to reduce such cross-over light easily because sensitivity is lowered or an optical transmissive image cannot be obtained.

In recent years, silver saving attempts with light-sensitive materials have been intensified to stretch resources and reduce costs. In the case of radiographic light-sensitive materials, these 'silver saving' activities have resulted in lowering the transmission density of an emulsion layer because of emulsion turbidity decreases. Consequently, the above-mentioned cross-over light increases; image sharpness deteriorates even further.

The present Applicants previously disclosed, in Japanese Patent Publication Open to Public Inspection (hereinafter referred to as Japanese O.P.I. Publication) No. 48544/1979, a negative type silver halide light-sensitive photographic material containing the following items as a novel means capable of considerable saving in the amount of silver needed:

(1) light-sensitive silver halide particles, (2) metallic salt particles which are relatively more easily soluble than the above-mentioned light-sensitive silver halide particles (1), not substantially light-sensitive, and to which a dissolution retarder is adsorbed, and (3) physical development nuclei.

This light-sensitive material can also be utilized as a radiographic light-sensitive material as a matter of course, because it can have the necessary photographic characteristics such as high sensitivity, high contrast, and high maximum density even though only a small amount of silver is used therein.

Still, this light-sensitive material is not an exception to the above mentioned increase in cross-over light resulting from silver reductions; this material has serious disadvantages in that the image sharpness is poor.

Taking the above-mentioned factors into consideration, the present invention has been devised.

It is, accordingly, an object of the invention that, by making use of the aforementioned negative type light-sensitive material, image sharpness is improved by eliminating or reducing cross-over light.

Another object of the invention is to provide a method of processing a radiographic light-sensitive material in which sharpness is high, the silver is reduced, and decreases in sensitivity are not so great as to require that radiation doses be increased.

SUMMARY OF THE INVENTION

The above-mentioned objects of the invention can be achieved in a radiographic image forming process comprising imagewise exposing a negative type, silver halide, light-sensitive, photographic material, in combination with an intensifying screen, to radiation and then treating the material with a processing solution.

The light-sensitive material comprises a support bearing constituent layers on each side of the support containing (a) light-sensitive silver halide particles, (b) metallic salt particles which are not light-sensitive and which are more readily soluble in a processing solution than said light-sensitive silver halide particles, but whose surfaces are rendered less soluble than the light-sensitive silver halide by a dissolution retarder, (c) physical development nuclei, and (d) compounds comprising at least one kind of water-soluble dye having an absorption maximum in an aqueous solution of from 400 to 600 nm or a compound comprising said water-soluble dye coupled to a non-diffusive mordant, said processing solution containing (i) at least one reducing agent, and (ii) at least one substance capable of dissolving the metallic salt particles.

DETAILED DESCRIPTION OF THE INVENTION PREFERRED EMBODIMENTS

Water-soluble dyes having an absorption maximum from 400 nm to 600 nm may be used in the constituent layers provided that they are in the absorption range of a complementary color to the emission spectrum of the fluorescent intensifying screen being used. The compounds having the following Formula [I] are preferred.

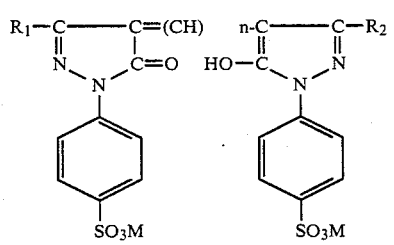

wherein $R_1$ and $R_2$ each represent a straight or branched chain alkyl having 1 to 7 carbon atoms, carboxyl, alkoxycarbonyl, alkylaminocarbonyl, amino, acylamino, or trifluoromethyl; M represents hydrogen, an alkali metal atom, or an ammonium group; and n is an integer of 1 or 3.

Among the groups represented by $R_1$ and $R_2$, the straight or branched chain alkyl includes methyl, ethyl, n-propyl, t-butyl and the like; the alkoxycarbonyl includes those having alkoxy groups containing 1 to 9 carbon atoms, especially methoxycarbonyl, ethoxycarbonyl, octyloxycarbonyl, and the like; and the alkylaminocarbonyl includes those whose alkyl portion has 1–9 carbon atoms, especially methylaminocarbonyl, diethyl aminocarbonyl, butylaminocarbonyl, octylaminocarbonyl, and the like. An amino group represented by $R_1$ or $R_2$ may include an unsubstituted amino group and an alkyl substituted amino group such as methylamino, diethylamino, butylamino, and the like; and an acylamino group includes acetylamino, benzoylamino, and the like. An alkali metal atom represented by M includes sodium, potassium, and the like.

The compounds of (d) of the light-sensitive material of the invention will be understood more readily with reference to the following typical examples; however, these examples are not to be construed as limiting the scope of the invention.

| (Exemplified compounds) | in $H_2O$ λmax(nm) |
|---|---|
| 1. 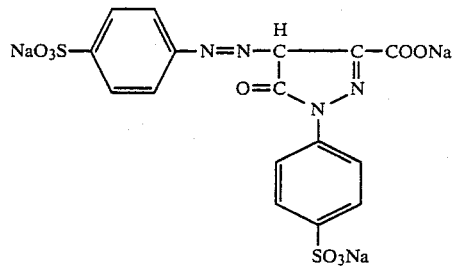 | 430 |
| 2. 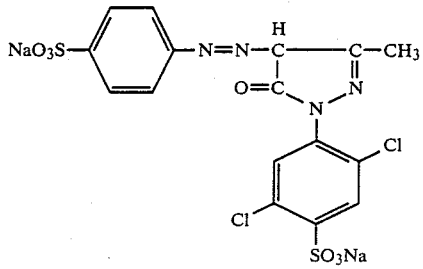 | 402 |
| 3. 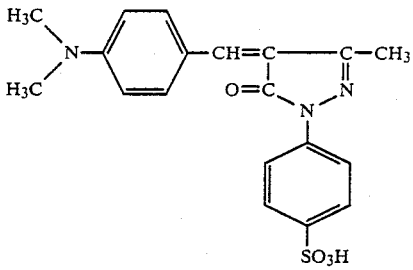 | 510 |
| 4. 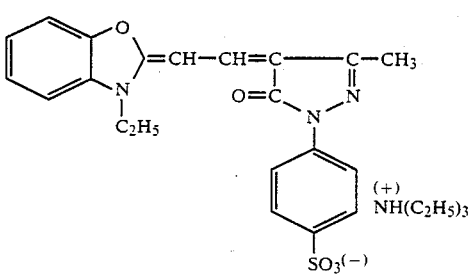 | 461 |

-continued
| (Exemplified compounds) | in $H_2O$ λmax(nm) |
|---|---|
| 5. 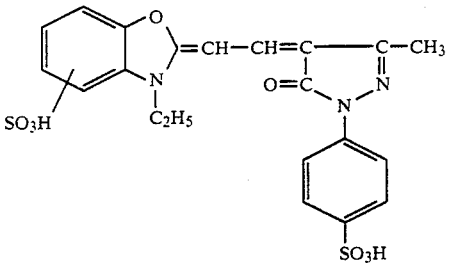 | 450 |
| 6. 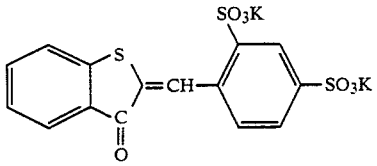 | 445 |
| 7. 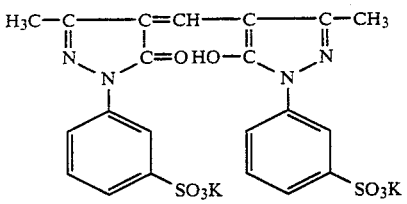 | 415 |
| 8. 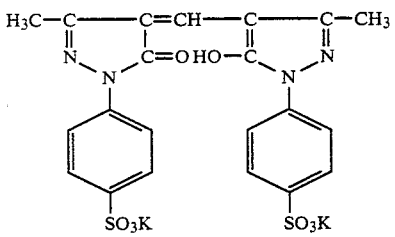 | 420 |
| 9. 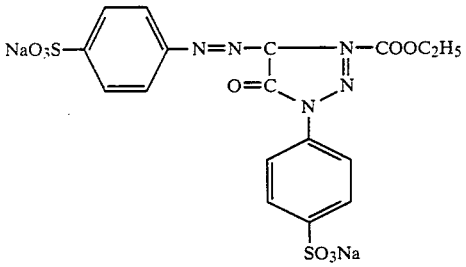 | 480 |
| 10. 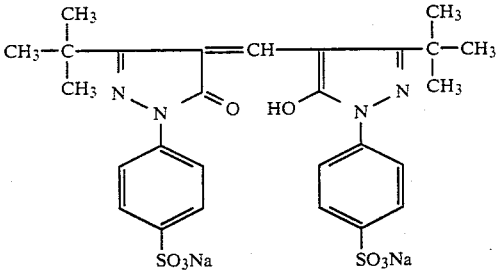 | 425 |

-continued
| (Exemplified compounds) | in $H_2O$ λmax(nm) |
|---|---|
| 11. 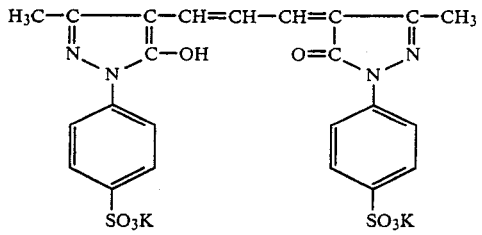 | 520 |
| 12. 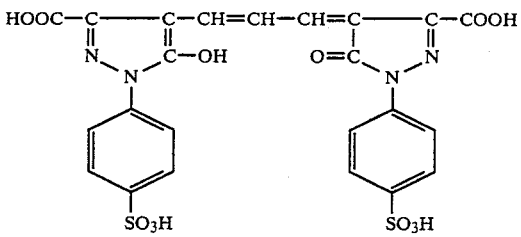 | 545 |
| 13. 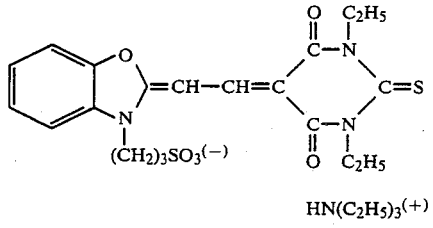 | 459 |
| 14. 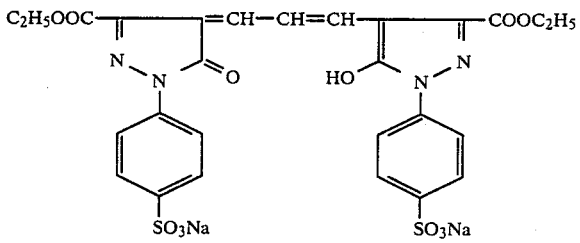 | 558 |
| 15. 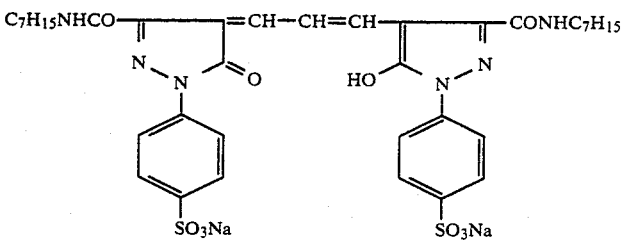 | 545 |
| 16. 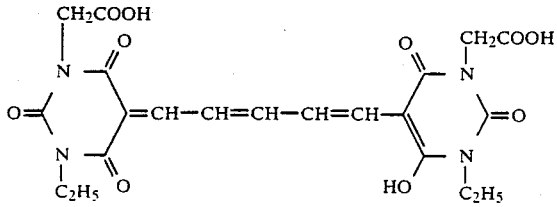 | 590 |

-continued

| (Exemplified compounds) | in $H_2O$ λmax(nm) |
|---|---|
| 17. 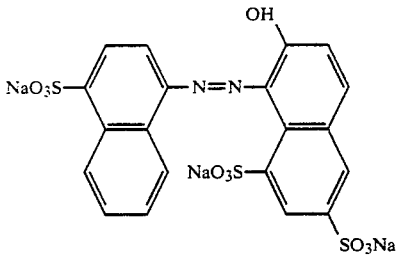 | 508 |

The above-exemplified dyes can readily be synthesized by the process described in, for example, British Pat. No. 560,385, U.S. Pat. No. 1,884,035, or Japanese Patent Examined Publication No. 22069/1964.

Selection may be made from the above-exemplified dye compounds according to the purposes of use. Examples of the preferable compounds are those having Formula [I].

Next, among the non-diffusive mordants to be coupled to the above-mentioned dyes of the invention, the preferred ones are polymers or copolymers having Formulas [II], [III] or [IV]:

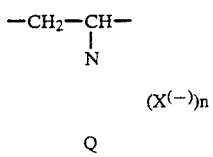

[II]

wherein Q represents a group of atoms necessary to complete, together with the N atom, an imidazole ring nucleus; X is an acid group, an acidic anion or a halide anion; and n is 0 or 1.

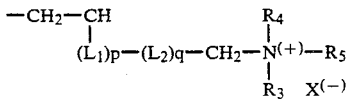

[III]

wherein $R_3$, $R_4$, and $R_5$ each represent an alkyl group having 1 to 8 carbon atoms and such alkyl group may have a substituent; $L_1$ represents —CONH— or

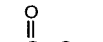

$L_2$ represents an alkylene or an arylene; p and q each have the value of 0 or 1; and X represents an acidic anion, or a halide anion.

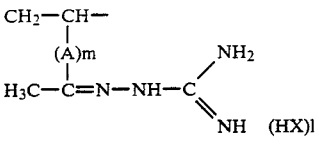

IV wherein A represents

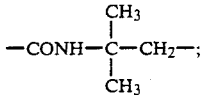

X represents an acid group; l is an integer of 1 or 2; and m is an integer of 0 or 1.

In the invention, polymers or copolymers having the above Formula [III] are more preferably those having the following Formula [V]

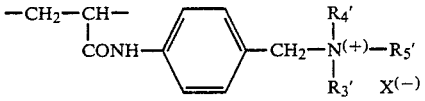

V wherein, $R'_3$, $R'_4$ and $R'_5$ each represent an alkyl group having 1 to 3 carbon atoms and such alkyl group may also have a substituent; and X represents an acidic anion or a halide anion.

In Formulas [II] through [V], the acid group or acidic anion represented by X includes a toluene sulfonic acid group and the like; and the halide anion includes a chlorine ion, iodine ion, and the like.

Further, the alkyl group represented by $R_3$, $R_4$ and $R_5$ includes methyl, ethyl, pentyl, hexyl, and the like; the alkyl group represented by $R'_3$, $R'_4$ or $R'_5$ includes methyl group, ethyl group and the like; and further, the substituent of the above-mentioned alkyl groups, if any, includes preferably an aryl group, and most preferably a phenyl group.

The alkylene group represented by $L_2$ includes, methylene and ethylene, and the arylene $L_2$ group preferably is phenylene.

In Formula [IV], the acid group includes, for example, an acetic acid group, toluenesulfonic acid group, chloric acid group, and the like.

The following are typical examples of the non-diffusive mordants of the invention, which have the above Formulas [II], [III] or [IV]; however, these examples are not to be construed to limit the scope of the invention.

| (Exemplified compounds) | |
|---|---|
| 1. 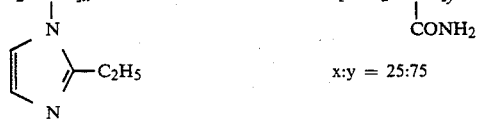 | x:y = 25:75 |

-continued
(Exemplified compounds)
2.
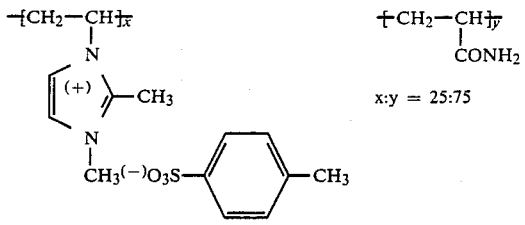
x:y = 25:75
3.
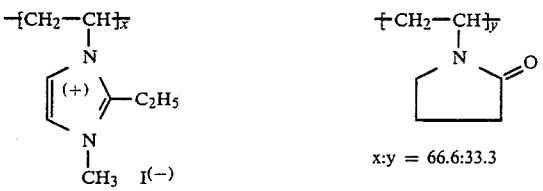
x:y = 66.6:33.3
4.
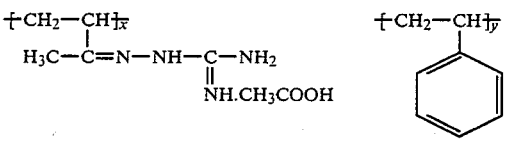
x:y = 66.6:33.3
5.
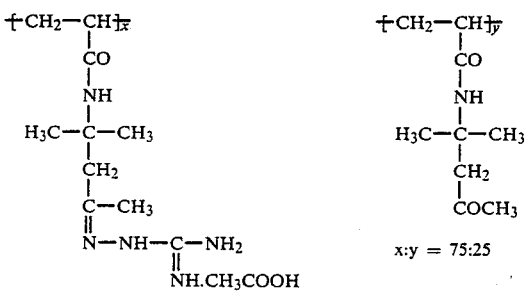
x:y = 75:25
6.
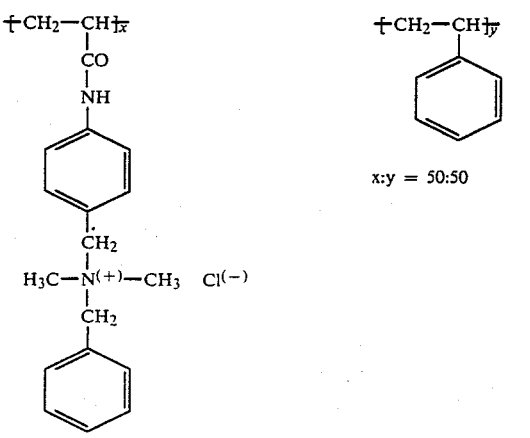
x:y = 50:50
-continued
(Exemplified compounds)
7.
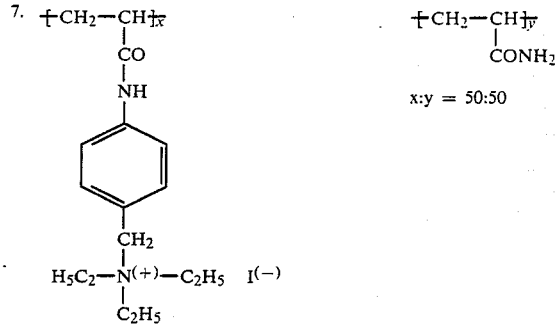
x:y = 50:50
8.
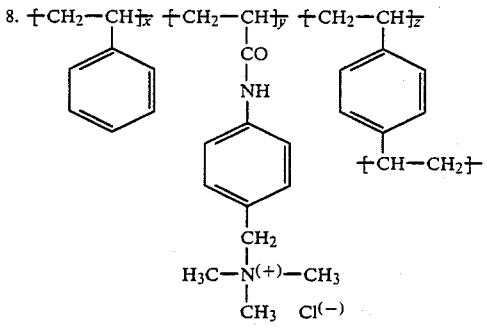
x:y:z = 48:48:4
9.
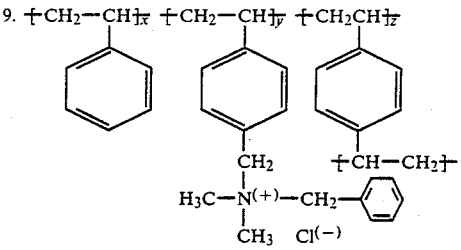
x:y:z = 49:49:2
10.
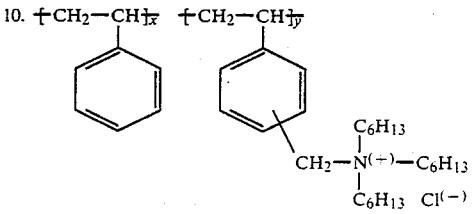
x:y = 50:50

-continued (Exemplified compounds)

11. 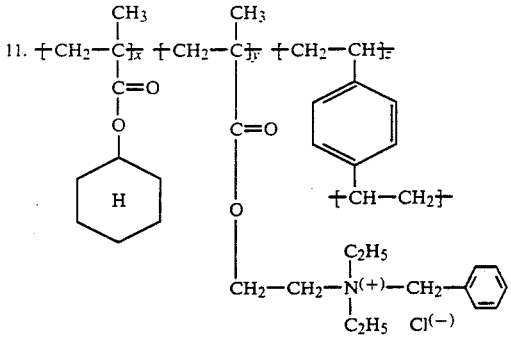

x:y:z = 48:48:2

These compounds can readily be synthesized by the processes described in Japanese Patent Examined Publication Nos. 15820/1974 and 1418/1976; Japanese Patent O.P.I. Publication Nos. 73440/1976, 129034/1978, 74430/1979, 155835/1979 and 22766/1980; and the like.

When using these compounds, they are dissolved in water, a hydrophilic organic solvent such as methanol or acetone, or the like.

Any one of the constituent layers of the light-sensitive materials relating to the invention can contain the dyes, as disclosed in Japanese Patent O.P.I. Publication No. 48544/1979. It is preferable, and effective, to add the dyes to a coating layer which contacts the transparent support.

The amount of the dyes added varies according to the compounds, and generally 0.05 mg to 50 mg per sq. meter is present. More preferably, 0.1 mg to 20 mg of the dye is used per sq. meter.

According to the invention, the water-soluble dyes of the invention may be used independently in a constituent layer or they may be coupled to the above-mentioned non-diffusive mordant compounds and the coupled product used in a constituent layer.

There are a variety of known processes whereby the non-diffusive mordants and the water-soluble dyes are coupled. Coupling them in a gelatin-binder is preferable. Coupling can also occur in a suitable binder followed by dispersing in an aqueous gelatin solution using ultrasonic waves. The proportion of dye to mordant varies with the particular compounds; however, it is usually 1 part: 0.1–10 part. When the coupled product is used, a larger amount of the water-soluble dyes may be incorporated into the layers than the amount of the water-soluble dyes used independently.

Further, when a constituent layer is required to contain a coupled product of a water-soluble dye and a non-diffusive mordant, the position of the layer can be selected arbitrarily. It is preferable to have the constituent layer serve as a coating layer coming into contact with the transparent support of the light-sensitive material.

The light-sensitive silver halides used in the invention include silver chloride, silver bromide, silver iodide, silver chlorobromide, silver iodobromide, silver chloroiodobromide, or mixtures thereof. Inter alia, a highly sensitive silver iodobromide is preferable and, in particular, silver iodobromide containing not more than 50 mole % of silver iodide is suitably used in the invention.

Light-sensitive silver halide particles of this kind are applied in the form of a silver halide emulsion. Such an emulsion can be prepared by a variety of known methods including those described in Japanese Patent Examined Publication No. 7772/1971, the so-called conversion emulsion processes such as the single-jet and double-jet emulsion processes described in U.S. Pat. No. 2,592,250, or the like.

The particles of the aforementioned light-sensitive silver halide include those having a variety of crystal habits. The particle size thereof may vary according to the purposes for which light-sensitive materials are used, the suitable sizes are usually from 0.1$\mu$ to 0.3$\mu$.

These light-sensitive silver halide emulsions are chemically sensitized by a variety of substances known to be useful for this purpose; e.g. reduction sensitizers, polyalkylene oxide, as well as sulfur, selenium, noble metals, or the like are suitable as sensitizers.

In addition, the light-sensitive silver halide emulsions may also be spectrally sensitized by making use of a variety of sensitizing dyes. Further, fog may be reduced by well-known stabilizers such as imidazoles, triazoles, azaindenes, and the like.

Metallic salt particles to be used in the light-sensitive material of the invention comprise metallic salt, having dissolution rates in a substance capable of dissolving the metallic salt particles (which will be described later) faster than those of the above-mentioned light-sensitive silver halides when the surfaces of the particles are not coated with a dissolution retarder. Also, the metallic salt particles are substantially not light-sensitive.

To be more detailed, when measuring both of the dissolution rates (the mass of a substance dissolved per unit of time) of the metallic salt particles group (A) and the light-sensitive silver halide particles group (B) in the presence of at least one kind of metallic salt dissolving agent, the total masses of the particles contained in the respective particle groups (A) and (B) are equal to each other. Under these conditions, the dissolution rate of particle group (A) should be faster than that of particle group (B). The following measurement method is suitable for verifying whether the above condition is satisfied.

Two kinds of suspension solutions are prepared, each containing hydrophilic colloids, into which light-sensitive silver halide particles and metallic salt particles, respectively, are introduced. Each suspension solution is coated onto a support; thus two kinds of samples are prepared.

The amounts of the light-sensitive silver halide, the metallic salts, and the hydrophilic colloids are the same in each sample. Sodium thiosulfate is the standard substance for a metallic salt dissolving agent, and the previously obtained samples are respectively dipped in 5% sodium thiosulfate solution (at 20° C.) without agitation. The dipping periods are fixed, for example, 2 seconds, 5 seconds and 8 seconds. Each sample is rapidly transferred into a water-tank and, after washing, is dried. The residual amounts of light-sensitive silver halide and metallic salts are measured and analyzed by a well-known method to obtain the residual percentages.

Drawing a graph of the residual percentages and the dipping periods, the rate of resistence to dissolution is obtained; $t_1$ is that of the light-sensitive silver halide and $t_2$ is that of the metallic salt particles. The values of $t_2/t_1$ are required to be not more than one and preferably not more than 0.7.

The metallic salt particles are readily soluble in the sense mentioned above and, at the same time, not substantially light-sensitive.

The meaning of "not substantially light-sensitive" in the invention is that the metallic salt particles are "non-light-sensitive" relative to the afore-mentioned light-sensitive silver halide. When applying a light energy (necessary for light-sensitizing the light-sensitive silver halide) to a light-sensitive material of the invention, the metallic salt particles in the light-sensitive material are not substantially sensitized. More specifically, the metallic salt particles of the invention are preferably fine particles, having, at most, one tenth of the light-sensitivity compared to that of the light-sensitive silver halide. The metallic salt particles may suitably be selected from those having the above property.

In one of the preferred embodiments of the invention, such metallic salt particles are silver halide particles which are substantially not light-sensitive, and they are selected from those which are dissolved faster than the above-mentioned light-sensitive silver halide particles by a substance capable of dissolving the silver halide particles. Other preferable metallic salt particles are cuprous halides and cupric halides.

Metallic salt particles preferably applicable to the light-sensitive materials relating to the invention are those of pure silver chloride, pure silver bromide or the silver halides which are not chemically sensitized. The crystals of these silver halides should be finer than those of the above-mentioned light-sensitive silver halide.

The metallic salt particles are to be used in an amount of 0.1 mole to 100 mole per mole of the light-sensitive silver halide. Such metallic salt particles are dissolved in the presence of a metallic salt dissolving agent (which is to be described later). Metal ions or metal complex ions resulted therefrom are reduced to metal on the physical development nuclei (described below) in the presence of a reducing agent.

As the physical development nuclei, there may be used noble metals such as gold, silver, platinum or the like, and the colloids thereof; metal sulfides such as those of silver, palladium, zinc, or the like; and metal selenides; or the like. Inter alia, metal colloids, obtained by reducing gold or silver compounds such as chloroauric acid, silver nitrate, a silver halide and the like; silver sulfide; or palladium sulfide are preferred.

These physical development nuclei contain a chemically active site capable of catalytically accelerating a process in which metal ions or metal complex ions produced by dissolving the aforementioned metallic salt are reduced to metals by a reducing agent; accordingly they are not necessarily physical particles.

The amounts of such physical development nuclei in a light-sensitive material vary according to the kinds of nuclei. When silver sulfide is used, suitable amounts, converted into metallic silver, are from 0.1 $mg/m^2$ to 1.0 $g/m^2$.

The compounds capable of retarding metallic salt particle dissolution are preferably those which retard dissolution of silver halide particles. These dissolution retardants are more specifically described in Japanese Patent O.P.I. Publication No. 48544/1979, including a mercaptotetrazole such as 1-phenyl-5-mercaptotetrazole, 1-(p-ethoxyphenyl)-5-mercaptotetrazole, and the like.

In the invention as described above, it is possible to vary the components according to the objects and the uses.

Light-sensitive materials to be used in the invention contain, on both surfaces of the transparent support thereof, the following four elements;

(a) Light-sensitive silver halide particles, (b) Substantially non-light-sensitive metallic salt particles more readily soluble than the light-sensitive silver halide particles mentioned in (a) and on which a dissolution retarder is adsorbed, making the metallic salt particles less soluble than the particles in (a), (c) Physical development nuclei, and (d) Water-soluble dyes.

The above-mentioned (a), (b), and (c) may be in different layers, or two or more arbitrarily selected from the above-mentioned (a) through (c) may be together in one and the same layer.

For example, it is possible to arrange, on and from the support, in order, a component layer containing the water-soluble dyes or the coupled material of the dyes to non-diffusive mordants, a component layer containing physical development nuclei, a component layer containing the metallic salt particles, a component layer containing the light-sensitive silver halide particles, and, if necessary, a component layer containing a developer for a silver halide. It is also possible to change the layer arrangement.

Further, it is possible to provide a triple-layer arrangement, on and from the support, in order, a component layer containing the coupled material of the water-soluble dyes to the non-diffusive mordants, a component layer containing the physical development nuclei and the developer for a silver halide, and a component layer containing the light-sensitive silver halide particles and the metallic salt particles both of which are mixed into one and the same layer. Still further, it is possible to provide a single layer on the support by coating a component layer containing the light-sensitive silver halide particles, the metallic salt particles, the physical development nuclei and the water-soluble dyes in one and the same layer.

Most preferably, a triple-layered arrangement is provided whenever the following layers are coated respectively in order from the support; the first component layer containing the coupled material of water-soluble dyes to non-diffusive mordants, the second layer containing the mixture of metallic salt particles and physical development nuclei coated thereon, and the third component layer containing light-sensitive silver halide particles only. Similarly desirable is a double-layer wherein one component layer contains a mixture of metallic salt particles, physical development nuclei and water-soluble dyes and the other component layer contains light-sensitive silver halide particles only.

The composition of the light-sensitive materials of the invention is as mentioned above and, in addition, they may also be used, if necessary, in conjunction with a protective layer, interlayer, auxiliary layer and the like.

In practicing the invention, light-sensitive silver halide particles, metallic salt particles, physical development nuclei, and coupled materials of water-soluble dyes to non-diffusive mordants are dispersed in suitable binders and introduced into the specific component layers of a light-sensitive material. A variety of hydrophilic colloids are used for such binders, and gelatin is preferably used.

To modify the physical properties of the coated layer in which the above-mentioned hydrophilic colloids are used as the binder, a variety of physical property improvers for layers may be used; e.g. hardeners.

In a coated layer composition in which a hydrophilic colloid is used as the binder, photographic additives such as gelatin plasticizers, surface active agents, matting agents, antistatic agents, thickeners or, if necessary silver halide developers may be used, provided the effect of the invention is not impaired thereby.

The supports include transparent ones such as a film of cellulose acetate, cellulose nitrate, polyethylene terephthalate, polyamide, polypropylene, polycarbonate, or the like. The particular support used varies with the intended use.

Fluorescent intensifying screens, such as the highly sharp screens for radiographic use made of calcium tungstate, are attached respectively to both surfaces of the light-sensitive material. The material is exposed to X-rays through the screen and then processed in a processing liquid containing a reducing agent and a substance capable of dissolving the metallic salt particles.

The reducing agents present in the processing liquid are preferably silver halide developing agents, which are well-known in the art. They are described in detail in C. E. K. Mees and T. H. James, "The Theory of the Photographic Process", Chapter 13, 3rd Edition, 1966, published by MacMillan Co., N.Y., or L. P. A. Mason, "Photographic Processing Chemistry", pp. 16–30, 1966, published by Focal Press, London. They may be used independently or in combination.

The substance capable of dissolving metallic salt particles is preferably one which interacts with the metallic salt particles to produce metal ions or soluble metal complex ions. According to the preferred embodiments of the invention, these dissolving agents are substances incapable of dissolving light-sensitive silver halide. Substances capable of dissolving metallic salt particles are also preferred if the salt particles have a solubility different from that of the light-sensitive silver halide and provided that the concentration of the dissolving agent is not enough to substantially dissolve the light-sensitive silver halide. Typical examples of such dissolving agents are: sulfites, such as sodium sulfite; thiosulfates, such as sodium thiosulfate, potassium thiosulfate, and ammonium thiosulfate; cyanates, such as potassium cyanate and sodium cyanate; thiocyanates such as sodium thiocyanate and potassium thiocyanate; amino acid-compounds, such as cystine and cysteine; thiourea compounds, such as thiourea, phenylthiourea, and 3,6-di-thio-1,8-octadiol; thioether compounds; and the like.

When sodium sulfite is the dissolving agent, the amount used is preferably 0.1 g to 100 g per liter, more preferably 10 g to 80 g per liter, since it is generally used as a preservative.

The pH value of the processing liquid is preferably not lower than 5, and most preferably about 5.5 to 13.2. The processing liquid may contain a variety of additives such as an alkalizer, a pH buffer, a development accelerator, an antifoggant, or the like. The temperature of the processing liquid is suitably 20° C. to 50° C., and the processing time is 5 sec. to 6 min.

According to the process using the above-mentioned processing liquid, the exposed light-sensitive silver halide particles are reduced by the reducing agent. Halogen ions generated by this reduction, particularly iodine or bromine ions, destroy metallic salt particles whose surfaces are coated by the dissolution retarder. Accordingly, the metallic salt particles are dissolved in the presence of the metallic salt dissolving agent and precipitated on the physical development nuclei, thereby forming a negative image. After processing, the steps of a stopping, fixing, washing and the like may be carried out in the usual manner for black-and-white light-sensitive materials.

In the radiographic image forming process of the invention, the sharpness of a radiographic image is remarkably improved and the sensitivity, gamma, and maximum density are negligibly affected. This improvement is much greater than that observed in the silver-saving process of the art with a material having only the 3 components, (a) to (c).

Accordingly, in a radiographic image forming process using a light-sensitive material having the four elements of the invention, image-sharpness is greatly improved by substantially eliminating cross-over light. As described above, the advantages of the invention are that an excellent radiographic image, i.e., an excellent medical x-ray image, can be obtained.

The following examples further explain, but do not limit the invention.

EXAMPLE 1

Preparation of the light-sensitive silver halide emulsion

Into a highly light-sensitive silver iodobromide emulsion containing 3.5 mole % of silver iodide and which has been gold-sensitized, sulfur-sensitized and ripened up to the maximum sensitivity in a known process, 0.2 grams of 4-hydroxy-6-methyl-1,3,3a,7-tetrazaindene per mole of silver halide was added as a stabilizer, to prepare a light-sensitive silver halide particle emulsion. The average particle size of this emulsion was about 1.3 μm.

Preparation of the metallic salt particles, i.e. silver halide particles substantially not light-sensitive.

Pure silver chloride emulsion comprising silver nitrate and sodium chloride was prepared in a neutralization process. The average particle size of this emulsion was about 0.1 μm.

Preparation of the physical development nuclei.

Into 10 ml of an aqueous solution of 1% polyvinyl alcohol of which the saponification and polymerization degrees were 99% and 1000, respectively, 50 ml of 0.2% chloroauric acid was added. The mixture was stirred at room temperature and 10 ml of 1% sodium borohydride was added to produce gold colloid physical development nuclei.

The silver chloride emulsion which works as the metallic salt was modified by adding 1.2 grams of 1-phenyl-5-mercaptotetrazole per mole of silver chloride as a dissolution retarder. An appropriate amount of saponin was added thereto and then the physical development nuclei, as chloroauric acid, were added in the amount of 120 mg per mole of the silver chloride emulsion.

The emulsion thus prepared was equally divided into five samples to prepare the five coating liquids. The water-soluble dyes of the invention were added as in Table 1. The support used in each case was polyethylene terephthalate which had been sublayered. The above coating liquids were applied uniformly to both surfaces of the supports.

In succession, appropriate amounts of each of saponin and formalin, which work as hardeners, were added to the light-sensitive silver halide emulsion. The mixture thereof was uniformly coated onto both surfaces of all of the above-mentioned silver chloride coated supports. The amounts of silver in the silver chloride layer, and in the light-sensitive silver halide layer, were 1.0 g/m$^2$ and 3.0 g/m$^2$, respectively.

One of each of the five kinds of the samples was allowed to stand for 3 days; the others were stored at elevated temperature and under high humidity. Both surfaces were exposed to light of 3.2 CMS through a wedge. Development was conducted at 35° C. for 30 seconds with a processing liquid whose formula is given below:

Processing liquid formula

| | |
|---|---|
| Phenidone | 1.0 g |
| Sodium sulfite anhydrous | 60 g |
| Hydroquinone | 16 g |
| Potassium bromide | 2.0 g |
| $K_2CO_3$ | 35 g |
| 5-methylbenzotriazole | 40 mg |
| Glutaric aldehyde (25%) | 5 ml |
| Add water to make | 1 liter |

The samples were fixed, washed and dried. Sensitometry was performed; the results are shown in Table 1.

TABLE 1

| Sample No. | | Amt. of Dyes Added [Silver Chloride Layer] | | Photographic Characteristics | | | | | | | | |
|---|---|---|---|---|---|---|---|---|---|---|---|---|
| | | | | Allowed to Stand (for 3 days) | | | 55° C. 20% RH (for 3 days) | | | 50° C. 80% RH (for 3 days) | | |
| | | Exemplification No. of Compound | mg/m² | Relative Sensitivity | Gamma | Fog | Relative Sensitivity | Gamma | Fog | Relative Sensitivity | Gamma | Fog |
| Control | 1 | — | 0 | 100 | 3.1 | 0.06 | 103 | 3.1 | 0.07 | 94 | 3.0 | 0.08 |
| Invention | 2 | 1 | 4 | 96 | 2.9 | 0.07 | 100 | 3.0 | 0.07 | 95 | 2.8 | 0.07 |
| | 3 | 5 | 3 | 97 | 3.0 | 0.06 | 97 | 2.9 | 0.07 | 96 | 2.9 | 0.06 |
| | 4 | 7 | 3 | 97 | 2.8 | 0.07 | 99 | 2.8 | 0.06 | 96 | 2.7 | 0.07 |
| | 5 | 8 | 4 | 96 | 3.0 | 0.06 | 98 | 3.0 | 0.06 | 96 | 2.9 | 0.06 |

As is obvious from Table 1, the photographic characteristics of the samples of the invention do not deteriorate, even if they are kept at high temperature and under high humidity for a long time.

In the table, the relative sensitivity means the sensitivity of each sample relative to the control having no dye and where sensitivity is taken as 100 after being allowed to stand for 3 days. The gamma values are from the gradient of the straight line portion of the characteristics curve.

EXAMPLE 2

Preparation of the coupled material of water-soluble dyes to non-diffusive mordants Into 100 ml of an aqueous solution containing 7% gelatin, 20 ml of an aqueous solution containing 3% non-diffusive mordant No. 8 and 20 ml of aqueous solution containing 2% water-soluble dyes No. 8 were added while stirring at 50° C., thereby preparing dispersed coupled materials.

In the same manner, except that the combination of the non-diffusive mordants with the water-soluble dyes was changed according to Table 2, the dispersed products comprising a variety of coupled materials were prepared. The respective coupled materials were mixed with appropriate amounts of saponin and then uniformly coated onto both surfaces of each polyethylene terephthalate film base which had been sublayered.

For the purpose of preparing the control samples, the solutions in which only the respective non-diffusive mordants were added to the gelatin solutions, and only the aqueous solutions of gelatin were coated similarly to the above.

Both surfaces of the above-mentioned coated film base were uniformly coated with the coating liquid prepared as follows. Silver chloride emulsion was used as the metallic salt particles and a methanol solution containing 1.0 gram of 1-(p-ethoxyphenyl)-5-mercaptotetrazole per mole of silver halide, as the dissolution retarder, was added thereto. In succession, an appropriate amount of saponin was added and then the aforementioned physical development nuclei, chloroauric acid, was introduced in an amount of 200 ml per mole of the silver chloride emulsion.

Further, in sequence, saponin and formalin, as hardeners, were added to a light-sensitive silver halide emulsion in a manner similar to Example 1. The mixture thereof was coated uniformly onto both surfaces of the above-mentioned coated film bases.

The prepared samples were processed in a manner similar to that in Example 1; the results are shown in Table 2.

TABLE 2

| Sample No. | | Additive in the lower-most layer | | | | Photographic Characteristics | | | | | | | | |
|---|---|---|---|---|---|---|---|---|---|---|---|---|---|---|
| | | Mordant added | | Dye added | | Allowed to Stand (for 3 days) | | | 55° C. 20% RH (for 3 days) | | | 50° C. 80% RH (for 3 days) | | |
| | | Exemplification No. of Compound | mg/m² | Exemplification No. of Compound | mg/m² | Relative Sensitivity | Gamma | Fog | Relative Sensitivity | Gamma | Fog | Relative Sensitivity | Gamma | Fog |
| Control | 6 | — | 0 | — | 0 | 100 | 3.1 | 0.06 | 103 | 3.1 | 0.07 | 94 | 3.0 | 0.08 |
| | 7 | 5 | 20 | — | 0 | 100 | 3.0 | 0.06 | 100 | 3.1 | 0.07 | 94 | 3.0 | 0.08 |
| | 8 | 8 | 10 | — | 0 | 100 | 3.1 | 0.06 | 101 | 3.0 | 0.07 | 95 | 3.0 | 0.08 |
| Invention | 9 | 5 | 10 | 1 | 4 | 100 | 3.1 | 0.07 | 102 | 3.1 | 0.07 | 98 | 3.0 | 0.07 |
| | 10 | 5 | 20 | 1 | 8 | 98 | 3.0 | 0.06 | 100 | 3.1 | 0.06 | 97 | 3.0 | 0.06 |
| | 11 | 8 | 20 | 1 | 8 | 100 | 3.0 | 0.06 | 101 | 3.0 | 0.06 | 100 | 2.9 | 0.06 |
| | 12 | 5 | 20 | 8 | 8 | 100 | 3.1 | 0.06 | 102 | 3.1 | 0.06 | 97 | 3.0 | 0.07 |
| | 13 | 8 | 5 | 8 | 5 | 98 | 3.1 | 0.07 | 100 | 3.1 | 0.07 | 100 | 3.1 | 0.07 |
| | 14 | 8 | 10 | 8 | 8 | 100 | 3.0 | 0.06 | 101 | 3.0 | 0.06 | 98 | 2.9 | 0.06 |

As is obvious from Table 2, no deterioration is caused in the photographic characteristics when water-soluble dyes are coupled to non-diffusive mordants, even when a large amount is added.

EXAMPLE 3

Samples 1 and 5 prepared in Example 1, Samples 6, 8, 11 and 14 prepared in Example 2, and Sakura Medical X-ray Film, Type A (mfd. by Konishiroku Photo Ind. Co., Ltd., Japan), a commercial radiographic light-sensitive material, as a reference sample, were exposed to X-rays. The exposure conditions were: lamp-voltage, 100 KVP; lamp current, 100 mA. The samples were then processed in a manner similar to that of Example 1. The samples thus processed were then measured for their image-sharpness.

The sharpness was measured with the lead OTF measurement chart having rectangular waves of from 0.8 line/mm to 10 line/mm in close contact with the rear surface of a fluorescent intensifying screen comprising calcium tungstate. The chart was facing the front. The sample was exposed to X-rays so that the density of the areas of the film surface unshaded by the lead chart are about 1.0 when both surfaces of the film were measured and totaled.

After processing, the emulsion layer on the front side to the X-ray source was peeled off, and the rectangular wave pattern on the other surface of the layer was measured using a Sakura Micro Densitometer, Model M-5 (mfd. by Konishiroku Photo Ind. Co., Ltd., Japan). The aperture size of the densitometer was 230 μm in the parallel direction and 25 μm in the rectangular direction. Magnification was 100X. The results obtained are shown in FIG. 1.

As is obvious from FIG. 1, the samples of the invention exhibit excellent sharpness in comparison with the control samples not containing any dye. Also, they are not inferior to Sakura X-ray Film, Type A, a silver rich commercial light-sensitive material.

EXAMPLE 4

The emulsion was prepared in exactly the same manner as that of Example 2 except that an appropriate amount of 5,5'-dichloro-9-ethyl-3,3'-di-(3-sulfopropyl-)oxacarbocyanine hydroxide was added as an ortho sensitizing dye to the light-sensitive silver halide emulsions of Example 2. The sample was prepared by using exemplified water-soluble dye No. 14 and exemplified non-diffusive mordant No. 3 as in Example 2. The photographic characteristics of the sample thus prepared were measured. Sharpness of the images was determined by combining the samples with gadolinium fluorescent intensifying screens as in Example 3. It was found that the photographic characteristics in this sample did not deteriorate at all or deteriorated to a much lesser extent during storage preservation. The sharpness of the image was remarkably improved.

Figure 1:
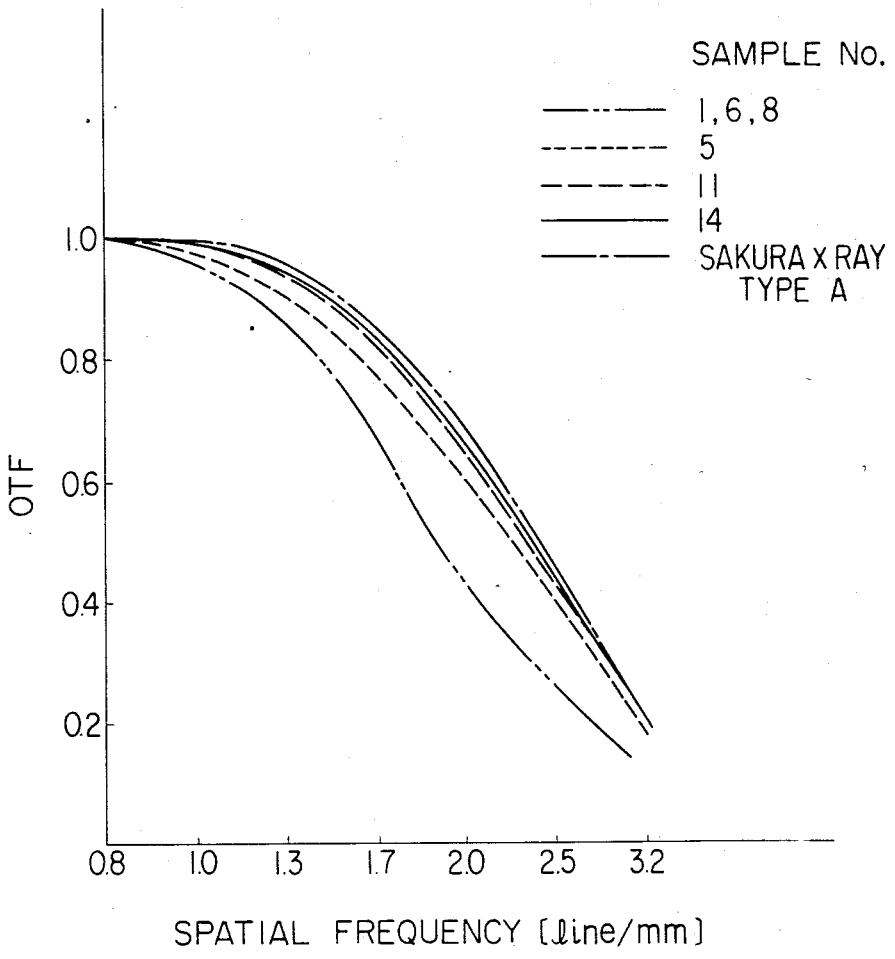
FIG. 1 is a graph exhibiting the relations between the OTF and the spatial frequencies in the examples of the invention.

We claim:

1. A radiographic image forming process comprising exposing a negative type silver halide photographic light-sensitive material, in combination with a fluorescent intensifying screen, imagewise to radiation rays, and treating said exposed material with a processing solution, said material comprising a support bearing on both sides thereof constituent layers, said constituent layers containing (a) light-sensitive silver halide particles, (b) metallic salt particles which are more readily soluble than said light-sensitive silver halide particles but whose surfaces are modified by a dissolution retarder so that said modified salt particles are rendered less soluble than said light-sensitive silver halide particles, (c) physical development nuclei, and (d) compounds comprising at least one kind of water-soluble dye having an absorption maximum in an aqueous solution from 400 to 600 nm, or a compound comprising said water-soluble dye coupled to a non-diffusive mordant, and said processing solution containing (i) at least one reducing agent, and (ii) at least one substance capable of dissolving said metallic salt particles.

2. A radiographic image forming process as claimed in claim 1, wherein said water-soluble dyes are the compounds having the following Formula I

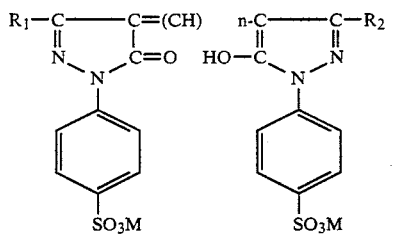

I wherein, $R_1$ and $R_2$ each represent a straight or branched chain alklyl group having 1 to 7 carbon atoms, a carboxyl group, an alkoxycarbonyl group, an alkylaminocarbonyl group, an amino group, an acylamino group, or a trifluoromethyl group; M represents hydrogen, an alkali metal atom, or an ammonium group; and n is an integer of 1 or 3.

3. A radiographic image forming process as claimed in claim 2, wherein the number of carbon atoms of the alkoxy group and the alkyl group in each of said alkoxycarbonyl group and said alkylaminocarbonyl group represented by $R_1$ and $R_2$ in said Formula I is independently 1 to 9.

4. A radiographic image forming process as claimed in claim 2, wherein said amino groups represented by $R_1$ and $R_2$ in said Formula I are individually alkyl substituted amino.

5. A radiographic image forming process as claimed in claim 2, wherein said non-diffusive mordants are polymers or copolymers having the following Formula II, III, or IV,

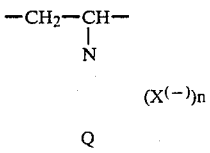

II wherein, Q represents a group of atoms, together with the N atom, necessary for completing an imidazole ring nucleus, X is an acid radical, an acid anion or a halide anion; and n is 0 or 1;

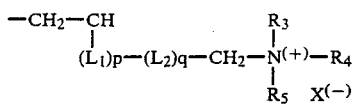

III wherein, $R_3$, $R_4$ and $R_5$ independently represent an alkyl group having 1 to 8 carbon atoms and said alkyl group may have a substituent; $L_1$ represents —CONH— or

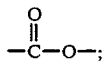

$L_2$ represents an alkylene or an arylene; p and q each have the value of 0 or 1; and X represents an acid anion or a halide anion;

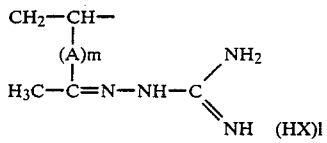

IV wherein, A represents

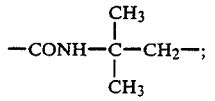

X represents an acid radical; l is an integer of 1 or 2; and m is an integer of 0 or 1.

6. A radiographic image forming process as claimed in claim 5, wherein polymers or copolymers having said Formula III are those having Formula V

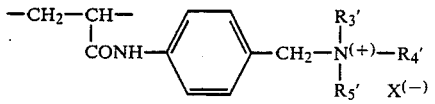

V wherein, $R'_3$, $R'_4$ and $R'_5$ each represent an alkyl group having 1 to 3 carbon atoms, and said alkyl group may also have a substituent; and X represents an acid anion or a halide anion.

7. A radiographic image forming process as claimed in claim 6, wherein said substituent on said alkyl represented by $R_3$, $R_4$ and $R_5$ in Formula V is aryl.

8. A radiographic image forming process as claimed in claim 1, wherein said constituent layer containing said water-soluble dye is a coated layer brought into contact face to face with said transparent support.

9. A radiographic image forming process as claimed in claim 1 wherein the amount of said water-soluble dyes added is from 0.05 mg to 50 mg. per square meter.

10. A radiographic image forming process as claimed in claim 9, wherein the amount of said water-soluble dye added is from 0.1 mg. to 20 mg. per square meter.

11. A radiographic image forming process as claimed in claim 1, wherein a constituent layer containing at least one kind of said water-soluble dye or the coupled product of at least one kind of said dye and said non-diffusive mordant is used as a coating layer brought into contact face to face with said transparent support.

12. A radiographic image forming process as claimed in claim 1, wherein said light-sensitive silver halide is silver iodobromide having a substantially high sensitivity.

13. A radiographic image forming process as claimed in claim 12, wherein said light-sensitive silver halide is silver iodobromide containing not more than 50 mole % of silver iodide.

14. A radiographic image forming process as claimed in claim 1, wherein said metallic salt particles are fine particles of a metallic salt having, at most, one tenth the photosensitivity of said light-sensitive silver halide.

15. A radiographic image forming process as claimed in claim 1, wherein said physical development nuclei are a metal colloid, silver sulfide, or palladium sulfide obtained by reducing a gold compound or a silver compound.

16. A radiographic image forming process as claimed in claim 1, wherein a triple-layered negative type silver halide photographic light-sensitive material is constituted by coating on a support, in order from the support, (a) a constituent layer containing a coupled product of said water-soluble dye and said non-diffusive mordant; (b) a constituent layer containing a mixture of said metallic salt particles and said physical development nuclei; and (c) a further constituent layer containing only said light-sensitive silver halide particles.

17. A radiographic image forming process as claimed in claim 1, wherein a double-layered negative type silver halide photographic light-sensitive material is constituted by coating, in order from the support side, (a) a constituent layer containing a mixture of said metallic salt particles, said physical development nuclei and said water-soluble dyes; and (b) another constituent layer containing only said light-sensitive silver halide particles.

18. A radiographic image forming process as claimed in claim 1, wherein at least one of said reducing agents is a silver halide developing agent.

19. A radiographic image forming process as claimed in claim 1, wherein at least one kind of said substances capable of dissolving said metallic salt particles is (a) a substance incapable of substantially dissolving said light-sensitive silver halide, or (b) a substance capable of dissolving metallic salt particles, wherein said salt particles have a solubility different from that of said light-sensitive silver halide and the concentration of said substance is not sufficient to substantially dissolve said light-sensitive silver halide.

20. A radiographic image forming process as claimed in claim 19, wherein said substance capable of dissolving said metallic salt particles is one selected from the group of a sulfite, a thiosulfate, a cyanate, a thiocyanate, an amino acid compound, a thiourea compound, and a thioether compound.

21. A radiographic image forming process as claimed in claim 1, wherein the pH of said processing liquid is about 5.5 to about 13.2.

22. A radiographic image forming process as claimed in claim 1, wherein said dissolution retarder is capable of retarding the dissolution of said metallic salt particles in said processing solution by being adsorbed on the surface of said metallic salt.

* * * * *